US009335700B2

(12) United States Patent
Takayama et al.

(10) Patent No.: US 9,335,700 B2
(45) Date of Patent: May 10, 2016

(54) BELT TRANSPORT APPARATUS, IMAGE FORMING APPARATUS, AND IMAGE FORMING SYSTEM

(71) Applicants: Hideyuki Takayama, Kanagawa (JP); Yusuke Ishizaki, Kanagawa (JP)

(72) Inventors: Hideyuki Takayama, Kanagawa (JP); Yusuke Ishizaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/611,389

(22) Filed: Feb. 2, 2015

(65) Prior Publication Data

US 2015/0220038 A1 Aug. 6, 2015

(30) Foreign Application Priority Data

Feb. 3, 2014 (JP) ..... 2014-018942
Jan. 26, 2015 (JP) ..... 2015-012561

(51) Int. Cl.
*G03G 15/00* (2006.01)
*G03G 15/16* (2006.01)

(52) U.S. Cl.
CPC ..... *G03G 15/6529* (2013.01); *G03G 15/50* (2013.01); *G03G 15/1615* (2013.01)

(58) Field of Classification Search
CPC ..... G03G 15/1615; G03G 2215/0158; G03G 15/5008; G03G 15/505; G03G 15/6529; B65G 12/04; B65G 2811/095; B65G 2203/00075
See application file for complete search history.

(56) References Cited

U.S. PATENT DOCUMENTS

| | | | | |
|---|---|---|---|---|
| 7,054,586 | B2 | 5/2006 | Kuroda | |
| 7,228,095 | B2 | 6/2007 | Kuroda | |
| 7,576,509 | B2 | 8/2009 | Komatsu et al. | |
| 7,696,713 | B2 | 4/2010 | Komatsu et al. | |
| 8,175,506 | B2 | 5/2012 | Takahashi et al. | |
| 8,364,064 | B2 | 1/2013 | Ashikawa et al. | |
| 8,474,816 | B2 | 7/2013 | Ishizaki et al. | |
| 8,660,473 | B2 | 2/2014 | Ashikawa et al. | |
| 2006/0153604 | A1 * | 7/2006 | Matsuda et al. | 399/301 |
| 2009/0190972 | A1 * | 7/2009 | Ohkubo et al. | 399/301 |
| 2009/0234498 | A1 * | 9/2009 | Takahashi et al. | 700/230 |
| 2010/0017019 | A1 * | 1/2010 | Andoh et al. | 700/229 |
| 2011/0044724 | A1 * | 2/2011 | Funamoto et al. | 399/167 |
| 2011/0081172 | A1 * | 4/2011 | Imamura et al. | 399/304 |

(Continued)

FOREIGN PATENT DOCUMENTS

| | | |
|---|---|---|
| JP | 2004-220006 | 8/2004 |
| JP | 2005-092763 | 4/2005 |
| JP | 2009-222112 | 10/2009 |
| JP | 2014-044410 | 3/2014 |

*Primary Examiner* — Clayton E Laballe
*Assistant Examiner* — Ruifeng Pu
(74) *Attorney, Agent, or Firm* — Oblon, McClelland, Maier & Neustadt, L.L.P.

(57) ABSTRACT

A belt transport apparatus includes a first computation unit that computes a first deviation between a surface speed of a belt and a target speed of the belt, a position controller that computes a speed correction value based on the first deviation, a speed deviation ratio computation unit that computes a ratio of the belt surface speed and a rotational speed of a driving roller, a second computation unit that selectively computes according to predetermined conditions one of a second deviation between the rotational speed and a sum of an increment of the speed correction value and the target speed and a third deviation between the rotational speed and a sum of a value corrected according to the ratio stored in a storage unit and the target speed, and a control unit that controls the rotational speed based on the one of the second and third deviations.

9 Claims, 8 Drawing Sheets

(56) References Cited

U.S. PATENT DOCUMENTS

| | | | | |
|---|---|---|---|---|
| 2011/0229163 | A1* | 9/2011 | Ishizaki | 399/36 |
| 2011/0293299 | A1* | 12/2011 | Yoshikawa et al. | 399/43 |
| 2012/0063820 | A1* | 3/2012 | Chiba et al. | 399/304 |
| 2013/0084086 | A1* | 4/2013 | Ikeda | 399/36 |
| 2014/0037300 | A1 | 2/2014 | Ishizaki | |
| 2014/0178101 | A1* | 6/2014 | Takatsu, Junya | 399/167 |
| 2014/0178102 | A1* | 6/2014 | Kato | 399/167 |
| 2014/0334855 | A1* | 11/2014 | Onishi et al. | 399/301 |

* cited by examiner

BELT TRANSPORT APPARATUS, IMAGE FORMING APPARATUS, AND IMAGE FORMING SYSTEM

BACKGROUND OF THE INVENTION

1. Field of the Invention

The present invention relates to a belt transport apparatus, an image forming apparatus, and an image forming system. More specifically, the present invention relates to a belt transport apparatus, an image forming apparatus, and an image forming system which are adapted to control a belt surface speed in a drive control of an intermediate transfer driving motor (which will be called a motor) for driving an intermediate transfer belt (which will be called a belt) using a sensor (linear scale sensor) to detect the surface speed of the belt and a sensor (encoder) to detect a speed of the intermediate transfer driving roller (which will be called a driving roller).

2. Description of the Related Art

In an image forming apparatus which controls a belt surface speed using the sensor (linear scale sensor) to detect the surface speed of the belt and the sensor (encoder) to detect the rotational speed of the driving roller, it is known that, when a toner image primarily transferred from a photoconductive drum onto the belt is transferred to a recording sheet, a secondary transfer roller is pressed against the belt and the recording sheet is interposed between the secondary transfer roller and the belt so that the toner image on the belt is transferred to the recording sheet.

In a case of a full-color image forming apparatus, toner images of multiple colors (which are typically the four colors: black, cyan, magenta and yellow) from corresponding photoconductive drums of the respective colors are sequentially superimposed on the belt, and it is important to maintain (control) the belt surface speed at a fixed level in order to prevent degradation of image quality, such as color deviation or banding (periodic density/color fluctuations in the sub-scanning direction of solid image).

However, in order to reduce the color deviation, it is desired that the sensor (linear scale sensor) that detects the belt surface speed measures a belt surface speed in an area where the toner images are superimposed. If the linear scale sensor is disposed in the primary transfer portion, the toner may be accumulated on a belt surface speed detection portion of the sensor depending on the structure of the sensor, and there is a possibility that the sensor is unable to detect accurate belt surface speed due to the accumulated toner.

In this respect, Japanese Laid-Open Patent Publication No. 2004-220006 discloses that, when the linear scale sensor is difficult to output a normal scale reading due to belt scale staining or the like, alternative control is performed in which a control using the linear scale sensor is switched to a control using the encoder.

Japanese Laid-Open Patent Publication No. 2005-092763 discloses that a belt surface speed detection result and a driving roller rotational speed detection result are selectively used as a control signal, and not only for a duration in which the belt surface speed detection result is found abnormal, but also throughout a duration from a driving roller stop state to a steady driving state, the control based on the driving roller rotational speed detection result is continuously performed.

Japanese Laid-Open Patent Publication No. 2009-222112 discloses a method of measuring the belt surface speed on the belt scale to control the belt surface speed by using double loops with the linear scale sensor and the driving shaft encoder, in which the belt surface speed is controlled using only the driving shaft encoder without using the belt scale sensor depending on the mode.

Furthermore, in a mode of an image forming apparatus in which five photoconductive drums are provided and only the photoconductive drum disposed in the most upstream position in the belt transport direction of the image forming apparatus is in contact with the belt, there may be a case in which the sensor to detect the belt surface speed cannot be used due to the internal structural layout of the apparatus. In such a case, the control of the belt surface speed is performed using only the encoder.

It is also known that when the normal reading of the belt scale sensor cannot be obtained, or in the above-described case, the alternative control is performed in which the control using the linear scale sensor is switched to the control using the encoder.

However, if the control of the belt surface speed is performed by using only the encoder as in the related art, for example, when the intermediate transfer belt driving roller is in an expanded state due to a rise of the atmospheric temperature, the belt surface speed may fluctuate according to the temperature change, and there is a problem that the accuracy of the belt surface speed control using only the encoder may be degraded.

SUMMARY OF THE INVENTION

In one aspect, the present invention provides a belt transport apparatus which controls a belt surface speed using a first detection unit to detect a surface speed of a belt and a second detection unit to detect a rotational speed of a driving roller and is capable of preventing the degradation of the accuracy of the belt surface speed control when the first detection unit is not used or cannot be used.

In an embodiment which solves or reduces one or more of the above problems, the present invention provides a belt transport apparatus including: a driving roller that drives a belt; a first detection unit that detects a surface speed of the belt; a second detection unit that detects a rotational speed of the driving roller; a first computation unit that computes a first deviation between the belt surface speed detected by the first detection unit and a target speed of the belt; a position controller that computes a speed correction value based on the first deviation computed by the first computation unit; a speed deviation ratio computation unit that computes a ratio of the belt surface speed detected by the first detection unit and the rotational speed of the driving roller detected by the second detection unit; a storage unit that stores the ratio computed by the speed deviation ratio computation unit; a second computation unit that selectively computes, according to predetermined conditions, one of a second deviation between the rotational speed of the driving roller detected by the second detection unit and a sum of an increment of the speed correction value computed by the position controller and the target speed of the belt and a third deviation between the rotational speed of the driving roller detected by the second detection unit and a sum of a value corrected according to the ratio stored in the storage unit and the target speed of the belt; and a control unit that controls the rotational speed of the driving roller based on the one of the second deviation and the third deviation computed by the second computation unit.

Other objects, features and advantages of the present invention will become more apparent from the following detailed description when read in conjunction with the accompanying drawings.

DETAILED DESCRIPTION OF THE PREFERRED EMBODIMENTS

A description will be given of embodiments with reference to the accompanying drawings.

A belt transport apparatus according to an embodiment of the invention controls a belt surface speed with good accuracy using a sensor (first detection unit) to detect a surface speed of a belt and a sensor (second detection unit) to detect a rotational speed of a driving roller, and switches a control mode according to an operational mode so that the belt surface speed is controlled using only the sensor to detect the rotational speed of the driving roller.

The belt transport apparatus according to the embodiment has the following features. In a state in which both the first detection unit to detect the belt surface speed and the second detection unit to detect the rotational speed of the driving roller are usable, a ratio of a detection result of the first detection unit and a detection result of the second detection unit is computed and stored (the ratio is computed after the normalization of speed measurements). When the speed control using only the second detection unit (alternative control or minor loop control) is performed, correction is performed using the stored ratio of the detection result of the first detection unit and the detection result of the second detection unit relative to a target speed. Hence, a possible deviation of the belt surface speed which may be produced when the speed control is switched to the alternative control may be minimized.

Figure 1:
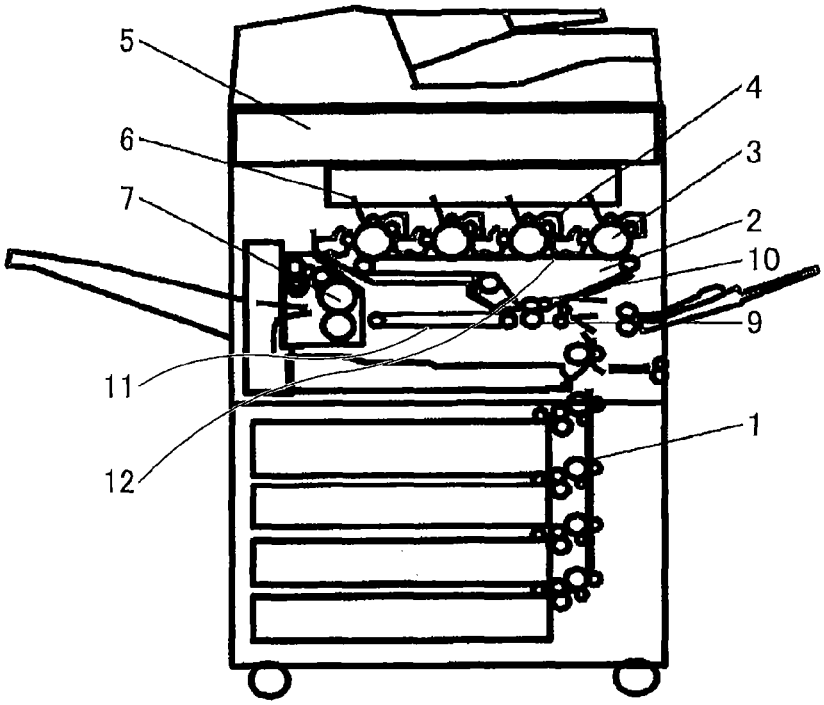
FIG. 1 is a schematic diagram showing an image forming apparatus including a belt transport apparatus according to an embodiment of the invention.

FIG. 1 is a schematic diagram showing an image forming apparatus including a belt transport apparatus according to an embodiment of the invention.

As shown in FIG. 1, the image forming apparatus includes a paper feed unit 1, an intermediate transfer unit 2, a photoconductor unit 3, a developing unit 4, a scanner unit 5, an image writing unit 6, a fixing unit 7, a secondary transfer roller 9, a counter roller 10, a transport unit 11, and a belt (intermediate transfer belt) 12.

The scanner unit 5 optically scans a document with a light beam emitted from a light source and reads image data from a reflected light beam from the document by using a three-line CCD (charge coupled device) sensor. Similar to a conventional image forming apparatus, the read image data is subjected to several image processing procedures, such as scanner gamma correction, color transformation, image separation, and gray-level correction processing by an image processing unit (which is not illustrated), and thereafter the image data is supplied to the image writing unit 6.

The image writing unit 6 modulates a driving signal of a LD (laser diode) according to the received image data. The photoconductor unit 3 writes a latent image to a uniformly charged surface of a rotating photoconductor drum by a laser beam emitted from the LD. The developing unit 4 forms a toner image by applying toner to the latent image on the surface of the photoconductor drum. The toner image formed on the photoconductor drum is transferred to a surface of the belt 12 of the intermediate transfer unit 2. In a case of a full-color copy, the toner images of the four colors are sequentially superimposed on the surface of the belt 12.

In the case of the full-color copy in which the toner images of the four colors of black (Bk), cyan (C), magenta (M) and yellow (Y) are superimposed, when the image formation and transfer processes of the toner images Bk, C, M and Y are completed, a copy sheet is fed from the paper feed unit 1 in timing in sync with the driving of the belt 12. The four toner images from the belt 12 are secondarily transferred to this copy sheet between the secondary transfer roller 9 and the counter roller 10 of the sheet transfer unit at a time. The copy sheet to which the toner images are transferred is supplied to the fixing unit 7 through the transport unit 11. In the fixing unit, the toner images are thermally fixed by a fixing roller and a pressure roller. Thereafter, the copy sheet is ejected from the fixing unit.

The image forming apparatus using the four color toners has been illustrated in FIG. 1. However, when outputting a full-color image with higher quality, a clear toner or the like may be added to make the toner image glossy. In such a case, a photoconductive drum for image formation using the clear toner is additionally disposed in the most upstream position in the transport direction of the intermediate transfer belt, and the five photoconductive drums in total are provided in the image forming apparatus.

Figure 2:
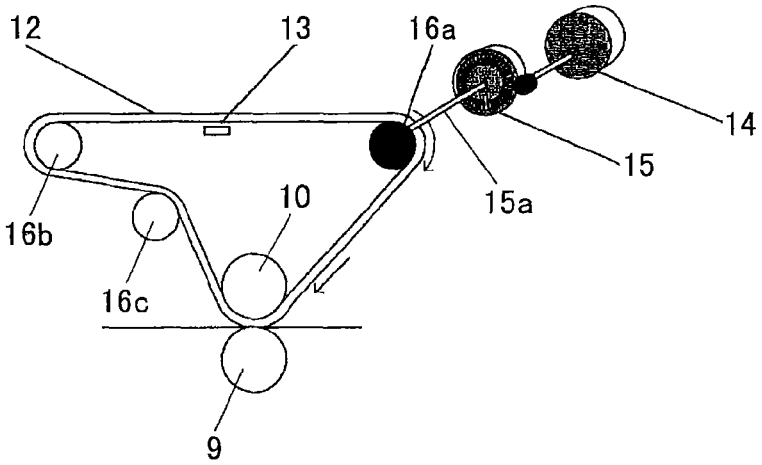
FIG. 2 is an enlarged view showing a principal part of the image forming apparatus in a vicinity of an intermediate transfer unit.

FIG. 2 is an enlarged view showing a principal part of the image forming apparatus in a vicinity of the intermediate transfer unit.

As shown in FIG. 2, the belt 12 is driven by an intermediate transfer motor (motor) 14. A gear reduction mechanism is disposed between the motor 14 and an intermediate transfer belt driving roller (driving roller) 16*a*, and a driving force from the motor 14 is transmitted to the driving roller 16*a* with a rotational speed to which the motor shaft speed is slowed down by the gear reduction ratio.

The speed of the belt 12 is controlled based on a detection value of an encoder 15 disposed on an intermediate transfer belt driving roller shaft (which will be called a "driving roller shaft") 15*a* and based on a detection value of a belt scale detection sensor (which will be called a "belt scale sensor") 13, so that the belt surface speed is consistent with a target speed and maintained at a fixed speed. In FIG. 2, reference numeral 16*b* denotes a driven roller and reference numeral 16*c* denotes a tension roller.

Figure 3:
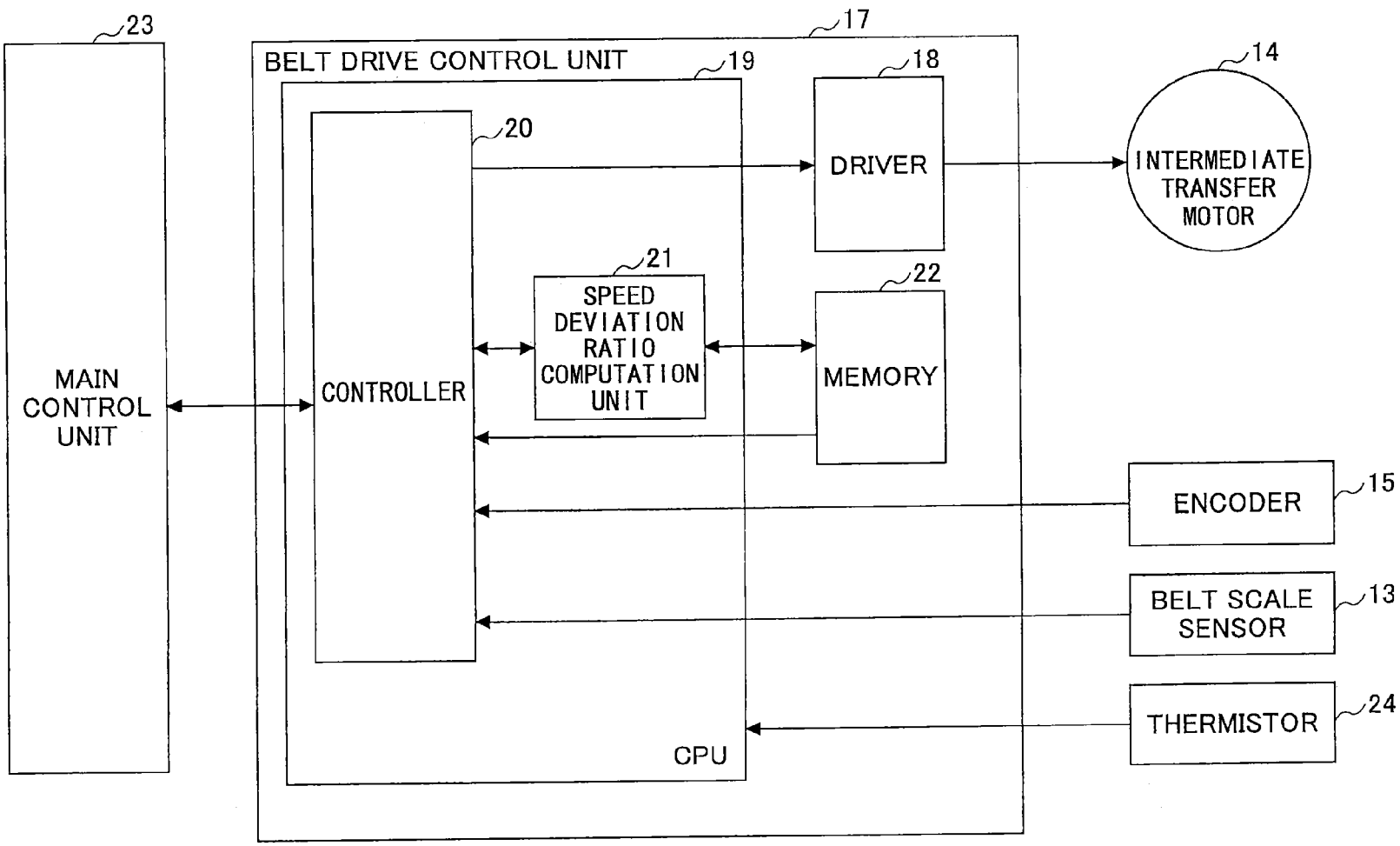
FIG. 3 is a block diagram showing a configuration of a belt drive control unit and a main control unit of the belt transport apparatus included in the image forming apparatus shown in FIG. 1.

FIG. 3 is a block diagram showing a configuration of a belt drive control unit 17 and a main control unit 23 of the belt transport apparatus included in the image forming apparatus shown in FIG. 1.

As shown in FIG. 3, the belt drive control unit 17 includes a driver 18 which drives the motor 14, a memory (which may also be called a "storage unit" or an "intermediate transfer scale feedback memory") 22, and a CPU (central processing unit) 19. The CPU 19 includes a controller 20 and a speed deviation ratio computation unit 21 and controls the respective units which constitute the belt drive control unit 17. The memory 22 stores a control value, such as a speed deviation ratio, which is computed by the speed deviation ratio computation unit 21, which will be described later.

When a start signal, a rotational direction indication signal, or a linear speed (belt surface speed) indication signal from the main control unit 23 is supplied to the CPU 19 of the belt drive control unit 17, the belt drive control unit 17 drives the motor 14 using the driver 18.

The controller 20 computes a speed of the motor 14 based on a speed signal of the encoder 15 of the driving roller shaft 15*a* and a speed signal of the belt scale sensor 13 and sends an output signal according to the result of computation to the driver 18. Namely, the controller 20 controls the belt surface speed by feedback control, so that the belt surface speed reaches a target speed and is maintained at a fixed level.

In FIG. 3, reference numeral 24 denotes a thermistor which is an example of a temperature detection unit which measures a temperature of a circumference of the belt or the belt driving roller.

Next, a configuration which performs a belt surface speed control in the belt transport apparatus according to the embodiment of the invention will be described. Prior to such description, a configuration of the controller 20 and its peripheral components for performing the belt surface speed control is described.

Figure 4:
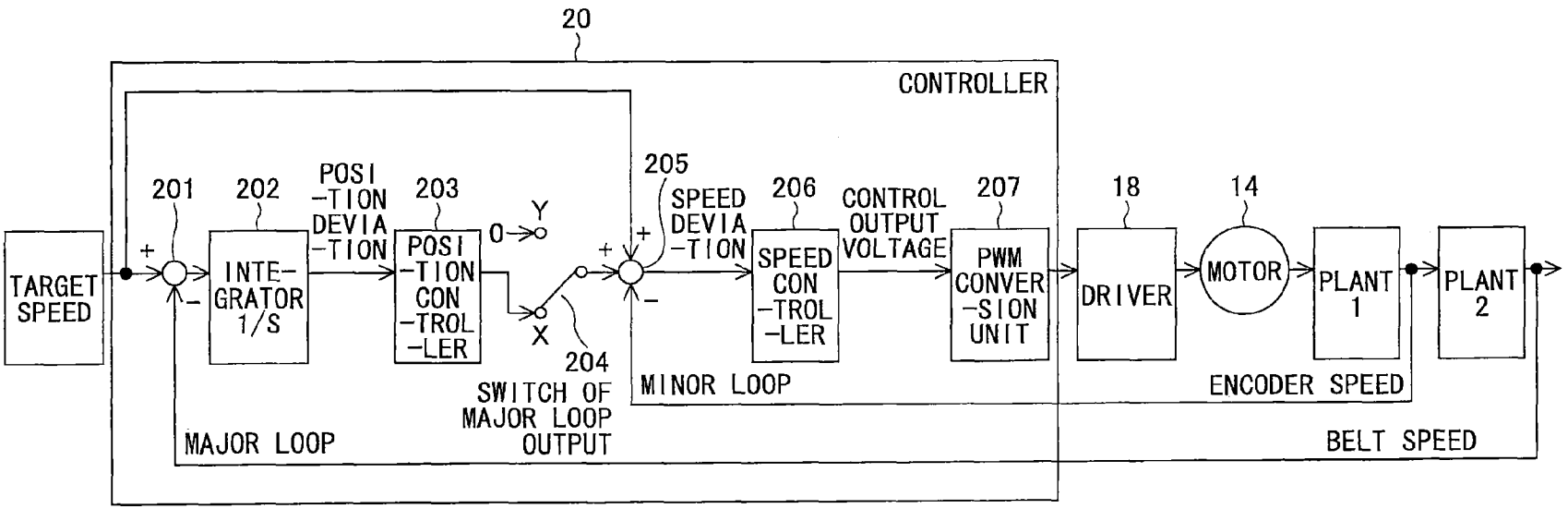
FIG. 4 is a block diagram showing a configuration of a controller and its peripheral components of the belt transport apparatus according to the embodiment of the invention.

FIG. 4 is a block diagram showing a configuration of the controller 20 and its peripheral components of the belt transport apparatus according to the embodiment of the invention.

As shown in FIG. 4, the controller 20 includes a first computation unit 201, an integrator (1/S) 202, a position controller 203, a switch 204 which is provided to connect a major loop output to 0 side (contact Y), a second computation unit 205, a speed controller 206, and a PWM (pulse width modulation) conversion unit 207 which are arranged along the flow of the processing.

Here, the major loop is a loop which feeds back a detection result of the belt scale sensor 13, and a minor loop is a loop which feeds back a detection result of the encoder 15.

The first computation unit 201 computes a speed error (first deviation) between a detection result (belt scale speed) of the belt scale sensor 13 (which is an example of the sensor to detect the surface speed of the belt) and a target speed (a first target speed) of the surface of the belt 12 output from the main control unit 23 or the CPU 19, and outputs the computed speed error to the integrator (1/S) 202.

The integrator (1/S) 202 computes a position deviation by integrating the result of computation of the first computation unit 201 (conversion). Subsequently, the position deviation computed by the integrator (1/S) 202 is input to the position controller 203.

An output signal (speed correction value) of the position controller 203 is supplied to the second computation unit 205 through the switch 204 of the major loop output (signal).

The second computation unit 205 computes a sum of the output signal (speed correction value; data A) of the position controller 203 and the first target speed. The sum computed by the second computation unit 205 serves as a target speed (second target speed) of the driving roller 16*a*.

Subsequently, a speed error computed based on the second target speed and a result of detection of the encoder 15 is input to the speed controller 206. The result of detection of the encoder 15 is a speed which is produced by converting the rotational speed of the driving roller shaft 15*a* detected by the encoder 15 into a surface speed of the driving roller 16*a*. The speed error input to the speed controller 206 is a second deviation (second deviation=target speed of the driving roller 16*a* (first target speed+speed correction value)−encoder detection speed).

The speed controller 206 performs a motor speed control which varies a control output voltage supplied to the motor 14 according to the second deviation received from the second computation unit 205, so that the surface speed of the driving roller 16*a* (i.e., the surface speed of the belt 12) is brought close to the target speed. Namely, the output obtained by the speed controller 206 serves as an indication value of the control output voltage supplied to the motor 14.

Subsequently, the obtained voltage indication value is converted into a PWM output (pulse) by the PWM conversion unit 207, and the PWM output is supplied to the driver 18 so that the motor 14 is driven by the driver 18.

Here, the controller 20 including the speed controller 206 and the PWM conversion unit 207 corresponds to a control unit defined in the claims.

The switch 204 of the major loop output is arranged to select one of a contact X and a contact Y for connection of the major loop output according to an input signal from the main control unit 23 or from the CPU 19, so that one of a belt scale feedback control (major loop control) using both belt scale speed and encoder speed and an alternative speed control (minor loop control) using only encoder speed is selected. As previously described, in a case of an image forming apparatus in which five photoconductive drums are provided and a mode wherein only the photoconductive drum disposed in the most upstream position in the belt transport direction is in contact with the belt 12 is provided, the switch 204 is actuated to select the contact Y (0 side) when the sensor (belt scale sensor) to detect the belt surface speed is not used in this mode or cannot be used due to the internal structural layout of the image forming apparatus (which will be called "predetermined conditions"), and the speed control of the motor 14 (or the belt 12) is performed using only the detection speed of the encoder 15.

The position controller 203 and the speed controller 206 are general-purpose controllers which are designed based on the frequency response results in which the input voltage to the motor 14 is used as the input and the encoder signal and the belt scale signal are used as the output. If the accuracy of the belt surface speed is maintained to some extent by performing the control (alternative control) using only the encoder detection speed, in a case where an error in the belt scale sensor 13 takes place or in a case where the control of the belt surface speed is performed without using the belt scale sensor 13, the switch 204 of the major loop output may be changed to the contact Y (0 side) and the control of the surface speed of the driving roller 16*a* (i.e., the control of the belt surface speed) may be performed without using the output (speed correction value) from the position controller 202.

However, as previously described, when the control of the belt surface speed is performed using only the encoder detection speed without using the detection result of the belt surface speed, the influence usually comes out.

For example, if the detection result of the belt surface speed is not used, the surface speed of the driving roller 16*a* may be increased to a speed higher than the desired speed for which the control is originally intended, when the driving roller 16*a* is in an expanded state due to a temperature change.

The rotational speed of the driving roller 16*a* is expressed by the formula V=rω (where V denotes the surface speed, r denotes a radius of the driving roller 16*a*, and w denotes an angular speed). If the radius "r" of the driving roller 16*a* varies due to a temperature change, the rotational speed V varies even when the angular speed "ω" is constant. Namely, even if the control of the belt surface speed is performed using the detection result (angular speed) of the encoder 15 to keep the speed value constant, the surface speed of the driving roller 16*a* cannot be maintained at a fixed level.

Figure 5A:
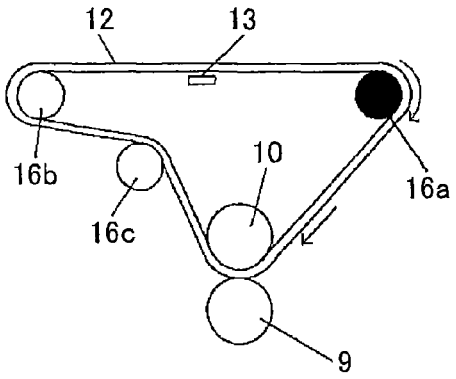
FIGS. 5A, 5B and 5C are diagrams for explaining the influence when detection of the belt surface speed is not performed (or when only the encoder control is performed).
Figure 5B:
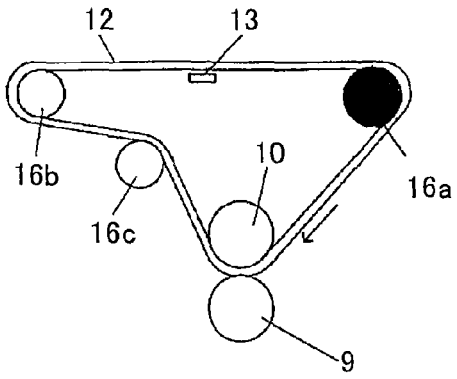
Figure 5C:
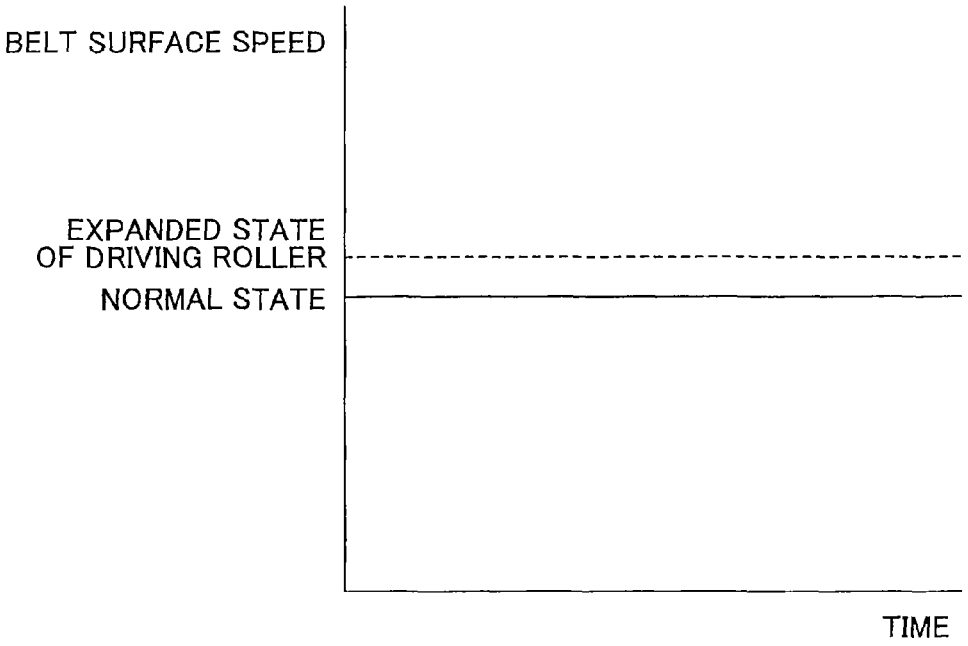

FIGS. 5A, 5B and 5C are diagrams for explaining the influence when the detection of the belt surface speed is not performed or when the control of the belt surface speed is performed using only the encoder detection speed.

FIG. 5A illustrates the principal part of the image forming apparatus in the vicinity of the intermediate transfer unit at a normal temperature (e.g., a room temperature), and FIG. 5B illustrates the principal part of the image forming apparatus in the vicinity of the intermediate transfer unit of the image forming apparatus at a raised temperature higher than the normal temperature. FIG. 5C is a diagram showing a relationship between the belt surface speed and elapsed time for each of the normal temperature case and the raised temperature case.

As shown in FIG. 5C, the belt surface speed when the driving roller 16*a* is in an expanded state is higher than the belt surface speed when the driving roller 16 is at the normal temperature.

A similar phenomenon may take place due to variations of the tolerance of the diameter of the driving roller regardless of the temperature change.

Next, the belt transport apparatus according to the embodiment of the invention which is adapted to overcome the above problem is described.

Figure 6A:
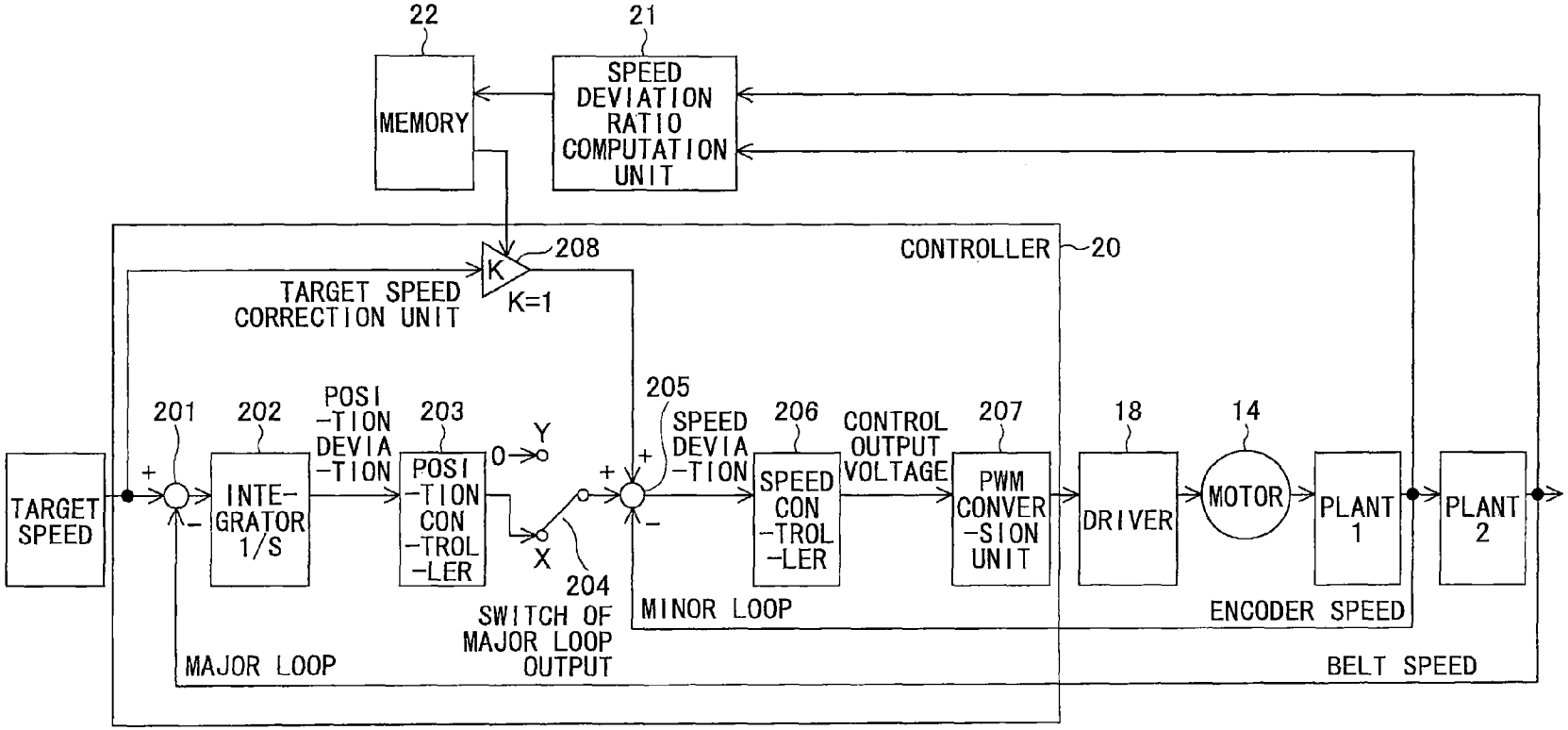
FIG. 6A is a block diagram showing a belt scale feedback control mode in which both a major loop and a minor loop are used.
Figure 6B:
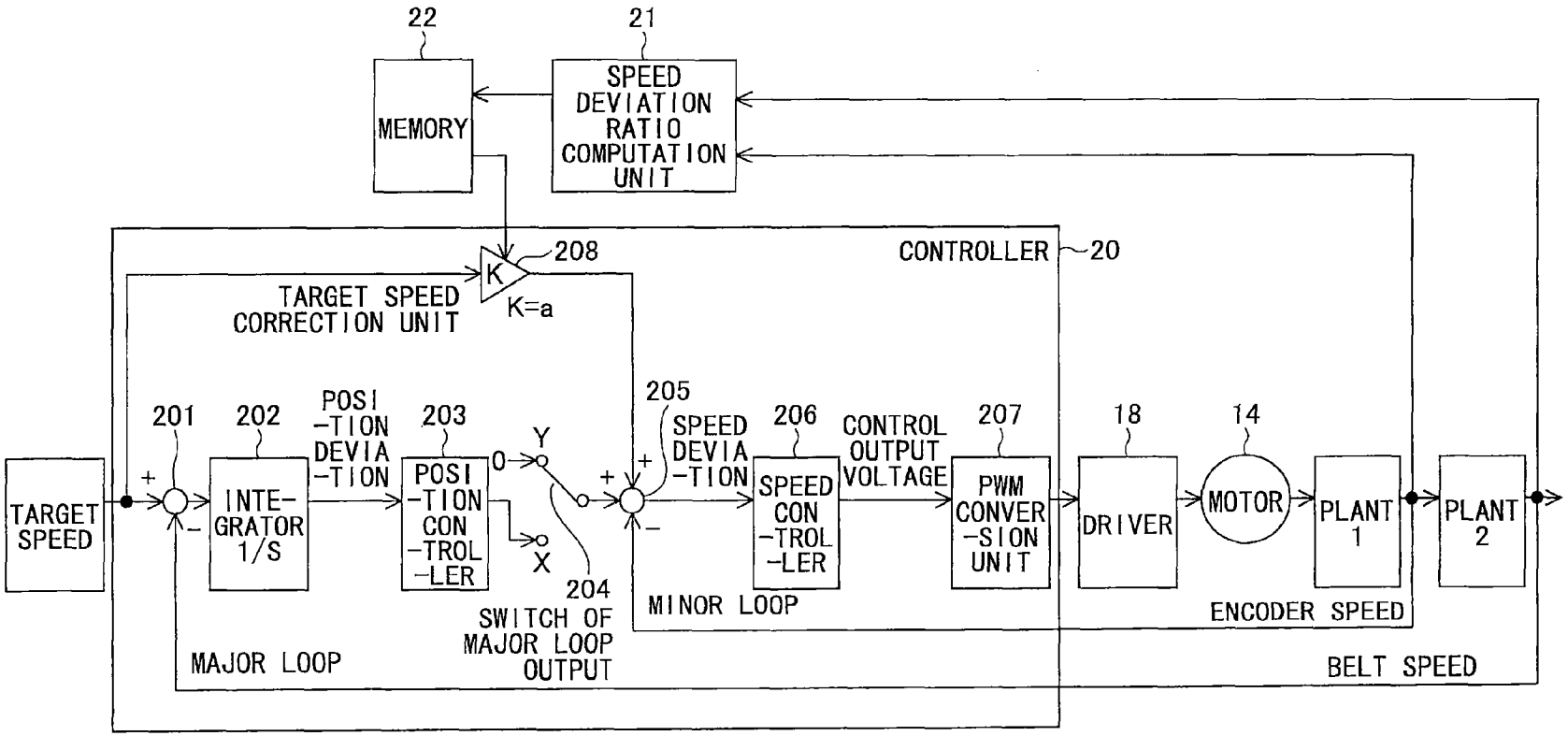
FIG. 6B is a block diagram showing a control mode using only a driving shaft encoder (or a control mode using only the minor loop).

FIG. 6A is a block diagram showing a belt scale feedback control mode of the controller 20 according to the embodiment of the invention (using both the major loop and the minor loop) and its peripheral components. FIG. 6B is a block diagram showing an alternative control mode of the controller 20 according to the embodiment of the invention (using only the minor loop including the encoder 15) and its peripheral components.

Here, the block diagrams of FIGS. 6A and 6B are compared with the block diagram of FIG. 4. In FIGS. 6A and 6B, the speed deviation ratio computation unit 21, the memory 22, and a target speed correction unit 28 that multiplies the target speed by a correction factor K (where K=1 or K=a) which are not shown in FIG. 4 are provided additionally. Other elements shown in FIGS. 6A and 6B are the same as those corresponding elements shown in FIG. 4. Hence, in FIGS. 6A and 6B, the elements which are the same as corresponding elements in FIG. 4 are designated by the same reference numerals, and a description thereof will be omitted.

The speed deviation ratio computation unit 21 computes a ratio (a) of the average of a driving roller rotational speed (v_enc) to the average of a belt surface speed (v_belt) in accordance with the formula: a=the average of driving roller rotational speed (v_enc)/the average of belt surface speed (v_belt).

Next, operation of the controller 20 in the belt scale feedback control mode shown in FIG. 6A is described.

The target speed correction unit 28 multiplies the target speed (the first target speed) by the correction factor K and inputs the multiplied target speed to the switch 204. Here, when the target speed correction unit 28 operates in the belt scale feedback control mode, K is set to 1 (K=1), and the target speed which remains unchanged is input to the second computation unit 205.

As previously described with reference to FIG. 4, the first computation unit 201 computes a speed error (first deviation) between a detection result of the belt scale sensor 13 (belt surface speed) and a target speed of the surface of the belt 12 output from the main control unit 23 or the CPU 19, and outputs the computed speed error to the integrator (1/S) 202.

The integrator (1/S) 202 computes a position deviation by integrating the result of computation of the first computation unit 201 (conversion). Subsequently, the position deviation computed by the integrator (1/S) 202 is input to the position controller 203.

An output signal (speed correction value) of the position controller 203 is supplied to the second computation unit 205 through the switch 204 of the major loop output (signal).

On the other hand, the target speed correction unit 208 corrects the target speed by the correction factor K (however, in this case, K=1, and the target speed remains unchanged) and sends the corrected target speed to the second computation unit 205 through the switch 204.

The second computation unit 205 computes a sum of the output signal (speed correction value) of the position controller 203 and the first target speed. The sum computed by the second computation unit 205 serves as a target speed (second target speed) of the driving roller 16*a*.

Subsequently, a speed error (second deviation) computed based on the second target speed and the result of detection of the encoder 15 is input to the speed controller 206. The result of detection of the encoder 15 is a speed which is produced by converting the rotational speed of the driving roller shaft 15*a* detected by the encoder 15 into a surface speed (rotational speed) of the driving roller 16*a*. The speed error input to the speed controller 206 is a second deviation (the second deviation=(target speed+speed correction value)−encoder detection speed).

The speed controller 206 performs a motor speed control which varies a control output voltage supplied to the motor 14 according to the second deviation received from the second computation unit 205, so that the surface speed of the driving roller 16*a* (i.e., the surface speed of the belt 12) is brought close to the target speed (the first target speed).

Subsequently, the obtained voltage indication value is converted into a PWM output (pulse) by the PWM conversion unit 207, and the PWM output is supplied to the driver 18 so that the motor 14 is driven by the driver 18.

Next, operation of the controller 20 in the alternative control mode shown in FIG. 6B is described.

In the alternative control mode, the switch 204 is set to the contact Y (0 side). Hence, the output of the position controller 203 (i.e., the output (speed correction value) of the main loop) is not used.

In this case, the ratio a stored in the memory 22 is read out instead of the speed correction value, and the ratio a is assigned to the correction factor K to correct the target speed. The target speed correction unit 28 assigns the ratio a to the correction factor K for the target speed and corrects the target speed. The corrected target speed (target speed $x_a$) is supplied to the second computation unit 205.

The second computation unit 205 computes a speed error based on the detection result (encoder detection speed) of the encoder 15 and the corrected target speed (the speed error=corrected target speed−encoder detection speed), and inputs the computed speed error (third deviation) to the controller 206.

As described above, the speed controller 206 obtains an indication value of the control output voltage to be supplied to the motor 14, based on the third deviation received from the second computation unit 205. Subsequently, the obtained voltage indication value is converted into a PWM output (pulse) by the PWM conversion unit 207, and the PWM output is supplied to the driver 18 so that the motor 14 is driven by the driver 18.

As described above, according to this embodiment, in the belt scale control mode which is a normal control mode, the target speed which remains unchanged is used for the control of the belt surface speed. Moreover, the speed deviation ratio computation unit 21 computes the ratio a of the average of the driving roller rotational speed (v_enc) to the average of the belt surface speed (v_belt) for a certain time period in the normal control mode, and stores the ratio a in the memory 22. Alternatively, the computation of the ratio a is not necessarily limited to the average of speed but a speed value at an arbitrary timing during a predetermined time period may be used instead.

Next, when the control mode (alternative control mode) using only the encoder 15 is to be selected, the switch 204 of the major loop output is switched from the contact X (for the normal control mode) to the contact Y (0 side). This causes the major loop output value to be reset to zero. Moreover, the ratio a is assigned to the correction factor K, and the target speed corrected by the ratio a is used.

Immediately after starting the motor 14, the controller 20 rotates the motor 14 by using only the control of the speed controller 206 (alternative control or minor loop control). After the rotation of the motor 14 is stabilized, the controller 20 performs the control using both the position controller 203 and the speed controller 206 (belt scale feedback control or major loop control). After the rotation of the motor 14 is stabilized, the speed deviation ratio computation unit 21 computes the ratio a by using the speed data for a predetermined time in the belt scale feedback control (major loop control) using both the position controller 203 and the speed controller 206.

Alternatively, the ratio a may be computed by using the speed data in a predetermined period from a state where the belt is driven by the control using both the position controller 203 and the speed controller 206 to a time immediately before a motor stop.

Figure 7:
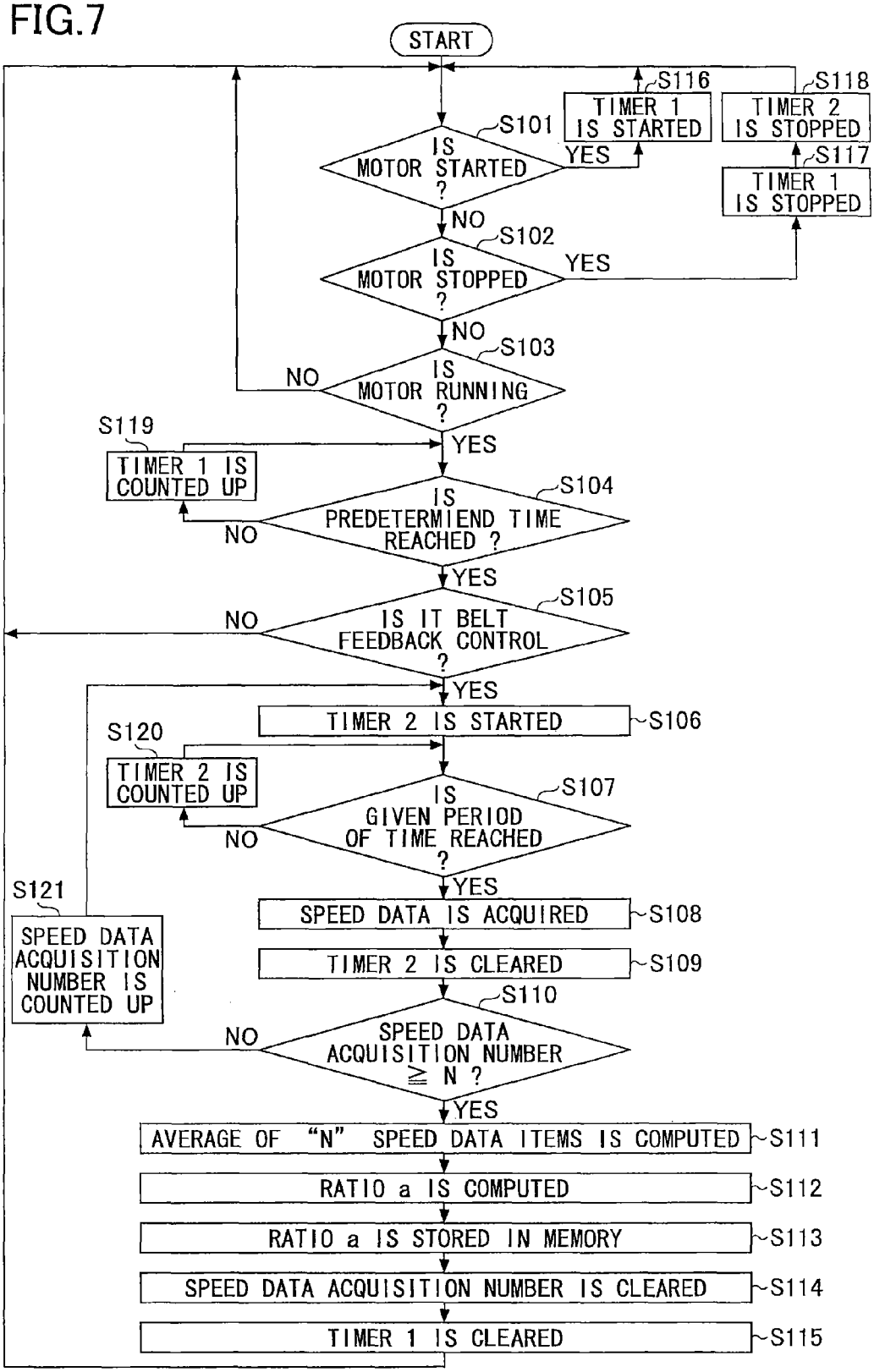
FIG. 7 is a flowchart for explaining a process of computation and storage of a ratio of the average of a driving roller rotational speed and the average of a belt surface speed according to an embodiment of the invention.

FIG. 7 is a flowchart for explaining a process of computation and storage of the ratio a of the average of a driving roller rotational speed (v_enc) and the average of a belt surface speed (v_belt) according to an embodiment of the invention. This process is performed by the CPU 19 shown in FIG. 3.

Upon start of the process shown in FIG. 7, it is determined whether the motor 14 is started from a stop state (S101). When the motor 14 is started from a stop state (S101, YES), a timer to measure elapsed time after a motor start (which will be called a timer 1) is started (S116). When the motor 14 is in a state from a motor start to a motor stop (S102, YES), the timer 1 is stopped (S117) and a speed data acquisition timer (which will be called a timer 2) is also stopped (S118).

When (i) the motor 14 is running (S103, YES), (ii) the timer 1 has reached a predetermined time (S104, YES), and (iii) the control mode is the belt scale feedback control mode (S105, YES), the timer 2 is started (S106). Subsequently, when the counted value of the timer 2 has reached a given period of time X (or when the given period of time has elapsed) (S107, YES), the speed data (the belt surface speed (v_belt) data and the driving roller rotational speed (v_enc) data) are obtained (S108).

After the speed data is obtained at step S108, the timer 2 is cleared (S109). In this manner, acquisition of the speed data is repeated each time the given period X of time has elapsed. When the speed data acquisition number is greater than or equal to a predetermined value N (S110, YES), the average of N speed data items is computed (S111), and the ratio a (=v_enc (average)/v_belt (average)) of the average of the driving roller rotational speed (v_enc) to the average of the belt surface speed (v_belt) is computed (S112). Subsequently, the computed ratio a is stored in the memory 22 (S112), and the speed data acquisition number and the counted value of the timer 1 are cleared (S114, S115). Then, the process is returned back to the start.

When the motor 14 is not running at step S103 (S103, NO), the motor 14 is not in operation and the process is returned back to the start.

When the timer 1 has not reached the predetermined time at step S104 (S104, NO), the timer 1 is counted up until the predetermined time is reached (S119).

When the control mode of the belt transport apparatus is not the belt scale feedback control mode at step S105 (S105, NO), acquisition of the speed data is not performed and the process is returned back to the start.

When the counted value X of the timer 2 (which corresponds to the given period of time) is not reached at step S107 (S107, NO), the timer 2 is counted up (S120). Namely, the waiting state is kept until the counted value of the timer 2 is set to the given period X of time.

When the speed data acquisition number is less than the predetermined value N at step S110 (S110, NO), the speed data acquisition number is counted up (S121) and the process is returned to step S106 in which the speed data acquisition is performed again. The speed data acquisition is repeated until the speed data acquisition number has reached the predetermined value N.

If the ratio a is already stored in the memory 22 upon start of the above process, the above process may be started by using the alternative control mode at a time of starting the motor. In such a case, when the predetermined time is measured by the counted value of the timer 1, the alternative control mode may be automatically shifted to the belt scale feedback control mode. In this case, the step S104 in the above process is replaced by a step of shifting the alternative control mode to the belt scale feedback control mode. The predetermined period in this case is a time needed for stabilizing the rotation of the motor, and a time to which a certain amount of margin is assigned is set up for this time. Thereby, in a state in which the rotation of the motor is stabilized, the alternative control mode is shifted to the belt scale feedback control mode.

The predetermined period from a start of the motor 14, the timer count value X, and the predetermined value N of the data acquisition number may be arbitrarily set up depending on the state of the belt transport apparatus.

Figure 8:
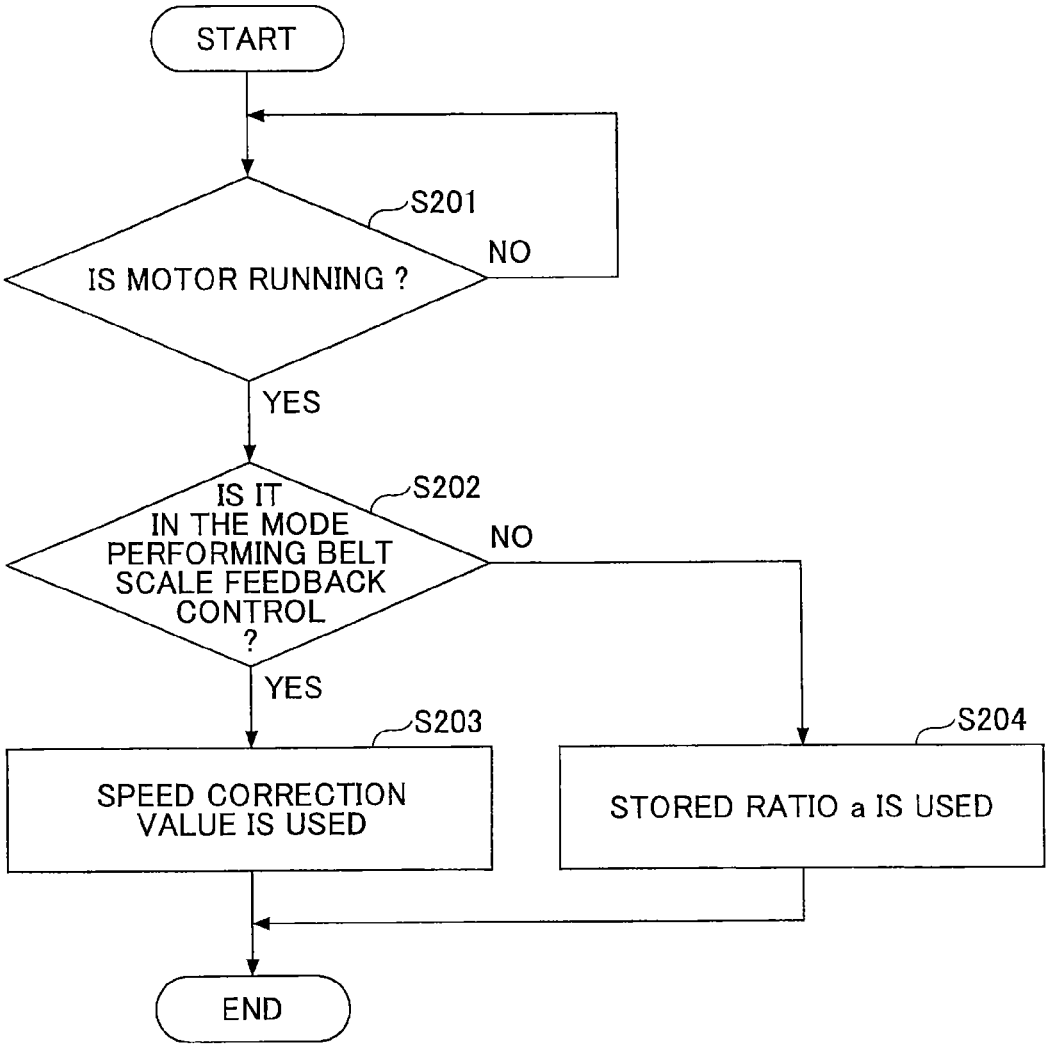
FIG. 8 is a flowchart for explaining a mode selection process performed upon starting of the belt transport apparatus according to the embodiment of the invention.

FIG. 8 is a flowchart for explaining a mode selection process performed upon starting of the belt transport apparatus according to the embodiment of the invention. This mode selection process is also performed by the CPU 19 shown in FIG. 3.

In the belt transport apparatus according to this embodiment, when (i) the motor 14 is running (S201, YES) and (ii) the belt transport apparatus is in the control mode which performs the belt scale feedback control using the belt scale sensor 13 (S202, YES), the switch 204 of the major loop output is set to the contact X as shown in FIG. 6A. Thereby, the output signal (speed correction value) of the position controller 203 which is the feedback value is used in the surface speed control of the driving roller 16*a* (i.e., in the surface speed control of the belt 12) (S203), and this process is terminated.

When the control mode is not the belt scale feedback control mode at step S202 (S202, NO), the switch 204 of the major loop output is set to the contact Y (0 side), and the ratio a of the average of the belt surface speed and the average of the driving roller rotational speed stored in the memory 22 is used as the minor loop output (S204), and this process is terminated.

The ratio a stored in the memory 22 reflects the belt scale speed and the driving roller rotational speed in the normal control mode, and it is possible to prevent the fluctuation of the surface speed due to an expanded state of the driving roller generated when the control of the belt surface speed is performed using only the encoder detection speed.

In the above-described process, acquisition of the speed data is performed after a predetermined time has elapsed from a start of the motor 14. The present invention is not limited to this embodiment. Alternatively, acquisition of the speed data may be performed for a predetermined period from starting of the motor 14 to a motor stop (or immediately before a motor stop). In this case, the starting timing of the timer 2 has to be changed according to the predetermined period described above based on the counted value of the timer 1. Other matters of the above-described process are essentially the same as those described with reference to FIG. 7.

As described above, in the belt transport apparatus according to this embodiment, when the speed data acquisition number has reached the fixed number N, the speed deviation ratio computation unit 21 computes the average of belt surface speeds and the average of driving roller rotational speeds for the N data items, and computes the ratio a between the average of belt surface speeds and the average of driving roller rotational speeds. The result of computation (the ratio a) is stored in the "ratio a" storage area of the memory 22. Subsequently, the process which performs the acquisition of N speed data items and computes the ratio a again is repeated and the result of computation (the ratio a) is overwritten to the "ratio a" storage area of the memory 22.

In the above embodiment, regardless of a temperature of the circumference of the belt or the driving roller, the ratio a is computed and stored in the memory 22. However, the present invention is not limited to this embodiment. Alternatively, the above process shown in FIG. 7 may be modified as follows. When the detection of the speed data (the driving roller rotational speed (v_enc) and the belt surface speed (v_belt)) is performed, a "ratio a" storage area of the memory 22 for storing the ratio a may be determined according to a detection result of the thermistor 24 in that time and the ratio a may be stored in the "ratio a" storage area of the memory 22. In that case, when an input signal indicating a control mode is received from the main control unit 23 or from the CPU 19 and the control mode (the alternative control mode in which the major loop output is reset to 0) which performs the control of the belt surface speed using only the detection speed of the encoder 15 is indicated by the input signal, the ratio a is changed and used according to the temperature detected by the thermistor 24. Thereby, the belt transport speed may be controlled in the alternative control mode with a higher level of accuracy.

Moreover, instead of reading the ratio a from the memory 22, a relational formula defining a relationship between a temperature and the ratio a may be created and retained, and when the control mode which performs the control of the belt surface speed using only the detection speed of the encoder 15 is indicated by the input signal, the ratio a may be computed by the formula according to the temperature and the computed ratio a may be used.

Furthermore, instead of using the relational formula of the temperature and the ratio a, a relational formula defining a relationship between an amount of change of temperature and a correction value of the ratio a may be created and retained. In this case, the ratio a is corrected according to a difference between the temperature when the ratio a is acquired and the temperature obtained from the detection result of the thermistor 24, and the correction value of the ratio a is used.

In this manner, the ratio a can be finely changed by retaining the relational formula. Thus, the belt transport speed can be controlled with a higher level of accuracy.

Alternatively, the image forming apparatus according to the invention may be connected via a dedicated line to a DFE (digital front end) which is not illustrated, so that the image forming apparatus may communicate with the DFE. The DFE may be adapted to include a function as a raster image processor which is configured to generate a raster image based on an image received from a PC (personal computer). Or, a raster image or the like may be transmitted from the DFE to the image forming apparatus. The image forming apparatus and the DFE may be connected together by a network. Alternatively, the image forming apparatus according to the invention may be arranged to have a function as a raster image processor which is configured to generate raster image data.

The memory and the speed deviation ratio computation unit may be separately disposed in the image forming apparatus. In a case in which the image forming apparatus is connected to the DFE, the memory and the speed deviation ratio computation unit may be disposed in the DFE, or a part of the memory and the speed deviation ratio computation unit may be disposed in the DFE and the remaining part may be disposed in the image forming apparatus. In this case, the memory, the speed deviation ratio computation unit and the image forming apparatus constitute an image forming system. In addition, the elements which constitute the controller 20 may be implemented by software, or may be implemented by hardware.

As described in the foregoing, in the belt transport apparatus according to the invention which controls a belt surface speed using a first detection unit to detect a surface speed of a belt and a second detection unit to detect a rotational speed of a driving roller, it is possible to prevent the degradation of the accuracy of the belt surface speed control when the first detection unit is not used or cannot be used.

The belt transport apparatus according to the present invention is not limited to the above-described embodiments and variations and modifications may be made without departing from the scope of the present invention.

The present application is based upon and claims the benefit of priority of Japanese patent application No. 2014-018942, filed on Feb. 3, 2014, and Japanese patent application No. 2015-012561, filed on Jan. 26, 2015, the contents of which are incorporated herein by reference in their entirety.

What is claimed is:

1. A belt transport apparatus comprising:

a driving roller that drives a belt;

a first detection unit that directly detects a surface speed of the belt;

a second detection unit that detects a rotational speed of the driving roller;

a first computation unit configured to compute a first deviation between the belt surface speed detected by the first detection unit and a target speed of the belt;

a position controller configured to compute a speed correction value based on the first deviation computed by the first computation unit;

a speed deviation ratio computation unit configured to compute a ratio of the belt surface speed detected by the first detection unit and the rotational speed of the driving roller detected by the second detection unit;

a storage unit that stores the ratio computed by the speed deviation ratio computation unit;

a second computation unit configured to compute, according to predetermined conditions, one of a second deviation between the rotational speed of the driving roller detected by the second detection unit and a sum of an increment of the speed correction value computed by the position controller and the target speed of the belt and a third deviation between the rotational speed of the driving roller detected by the second detection unit and a value of the target speed of the belt corrected according to the ratio stored in the storage unit; and a control unit configured to control the rotational speed of the driving roller based on the one of the second deviation and the third deviation computed by the second computation unit.

2. The belt transport apparatus according to claim 1, wherein the speed deviation ratio computation unit is configured to compute the ratio of the belt surface speed and the rotational speed of the driving roller when a predetermined period has elapsed after a motor start.

3. The belt transport apparatus according to claim 1, wherein the speed deviation ratio computation unit is configured to compute the ratio of the belt surface speed and the rotational speed of the driving roller immediately before a motor stop.

4. The belt transport apparatus according to claim 1, wherein the control unit is configured control the rotational speed of the driving roller based on the third deviation for a predetermined period after a motor start, and control the rotational speed of the driving roller based on the second deviation after the predetermined period has elapsed from the motor start.

5. The belt transport apparatus according to claim 1, further comprising:

a temperature detection unit that detects a temperature of a circumference of the belt or the driving roller, wherein the ratio of the belt surface speed detected by the first detection unit and the rotational speed of the driving roller detected by the second detection unit is stored in a storage area of the storage unit according to a detection result of the temperature detection unit, and the rotational speed of the driving roller is controlled based on the ratio stored in the storage area of the storage unit according to a current temperature when a control mode which controls the rotational speed of the driving roller based on the third deviation is indicated by an input signal.

6. An image forming apparatus comprising the belt transport apparatus according to claim 1, wherein the belt is arranged to transport at least one of a toner image, a latent image and a sheet-like medium.

7. The belt transport apparatus according to claim 1, wherein the first detection unit is a belt scale sensor and the second detection unit is an encoder.

8. An image forming system including an image forming apparatus, a storage unit, and a speed deviation ratio computation unit, wherein the image forming apparatus comprises:

a driving roller that drives a belt;

a first detection unit that directly detects a surface speed of the belt;

a second detection unit that detects a rotational speed of the driving roller;

a first computation unit configured to compute a first deviation between the belt surface speed detected by the first detection unit and a target speed of the belt;

a position controller configured to compute a speed correction value based on the first deviation computed by the first computation unit;

a second computation unit configured to compute, according to predetermined conditions, one of a second deviation between the rotational speed of the driving roller detected by the second detection unit and a sum of an increment of the speed correction value computed by the position controller and the target speed of the belt and a third deviation between the rotational speed of the driving roller detected by the second detection unit and a value of the target speed of the belt corrected according to a ratio stored in the storage unit; and a control unit configured to control the rotational speed of the driving roller based on the one of the second deviation and the third deviation computed by the second computation unit, wherein the speed deviation ratio computation unit is configured to compute a ratio of the belt surface speed detected by the first detection unit and the rotational speed of the driving roller detected by the second detection unit, and the storage unit stores the ratio computed by the speed deviation ratio computation unit.

9. The belt transport apparatus according to claim 8, wherein the first detection unit is a belt scale sensor and the second detection unit is an encoder.

* * * * *